US005638570A

United States Patent [19]

Gruner

[11] Patent Number: 5,638,570

[45] Date of Patent: Jun. 17, 1997

[54] DRYWALL BULLNOSE CLEANER TOOL

[76] Inventor: Glen A. Gruner, 2317 Parkwood Ct., Santa Rosa, Calif. 95409

[21] Appl. No.: 556,446

[22] Filed: Nov. 15, 1995

[51] Int. Cl.[6] ..... B05C 17/00

[52] U.S. Cl. ..... 15/235.7; 15/236.07; 15/236.05; 425/458; D8/19; D8/45

[58] Field of Search ..... 15/105, 105.5, 15/235.3–235.8, 236.01, 236.05, 236.07, 236.09, 245.1; 425/458; D8/14, 16, 19, 45, 105; D32/40, 42, 46, 49, 51

[56] References Cited

U.S. PATENT DOCUMENTS

| | | | |
|---|---|---|---|
| D. 152,781 | 2/1949 | Gier | D8/19 |
| 2,236,365 | 3/1941 | Clark | 15/235.7 X |
| 3,046,670 | 7/1962 | Wydra | D8/19 X |
| 4,295,242 | 10/1981 | Dixon | 15/235.7 |
| 5,345,642 | 9/1994 | Faldetta | 15/236.05 X |
| 5,392,484 | 2/1995 | Stoltzfus | 15/235.7 |
| 5,440,776 | 8/1995 | Kartler | 15/235.7 |

*Primary Examiner*—Mark Spisich
*Attorney, Agent, or Firm*—Daniel R. Kimbell

[57] ABSTRACT

A tool for scraping material from a bullnose installed on a corner joint of a drywall installation includes an elongated device having a handle portion, a first end portion, a second end portion, and a size adapted for holding in one hand. The first end portion has a first convexly shaped edge that matches a concavely shaped portion of the bullnose. It enables a user to scrape the material from the bullnose by moving the convexly shaped edge along the concavely shaped portion of the bullnose. Preferably, the first concavely shaped edge is shaped in a 75-degree arc of 0.875 inch radius to match a convexly shaped portion of the bullnose when the bullnose is installed on a 90-degree corner joint, and the second end portion of the elongated device includes a second convexly shaped edge that is shaped in a 50-degree arc of 1.125 inch radius to match the concavely shaped portion of the bullnose when the bullnose is installed on a 135-degree corner joint. One embodiment takes the form of a 6.5 inch long aluminum bar having the specified shaped.

6 Claims, 1 Drawing Sheet

DRYWALL BULLNOSE CLEANER TOOL

BACKGROUND OF THE INVENTION

1. Technical Field

This invention relates generally to drywalling equipment, and more particularly to a tool for drywallers to use in cleaning a bullnose during the installation of drywall.

2. Description of Related Art

Recall that a bullnose is a rounded metal strip designed for placement over a drywall corner joint. It reinforces and protects the edges of the drywall sheets from damage and it includes a convexly shaped (or rounded) portion intermediate opposite marginal edges. Installation involves cleaning drywall compound from the convexly shaped portion of the bullnose, and existing methods of doing so have certain drawbacks that need to be overcome.

To see why, consider the steps a drywaller (i.e., an installer of drywall) undertakes to install the bullnose at a typical corner. First, the drywaller nails or screws sheets of drywall to studs or other supporting structure so that the edges of some sheets nearly meet at the corner. Next, he places the bullnose over the corner so that the convexly shaped portion of the bullnose covers the corner and the marginal edges of the bullnose overlap the adjacent edges of the sheets. Then, he nails or screws the bullnose in place.

After that is accomplished, the drywaller tapes the drywall with tape and all purpose taping compound. That step includes placing strips of tape so that they overlap the marginal edges of the bullnose and the drywall sheets. Using the straight edge of a six-inch knife, the drywaller then wipes excess drywall compound from the tape and the drywall. He also scrapes excess from the convexly shaped portion of the bullnose as best he can with the straight edge of the knife. Then, he allows the first coat to dry.

After the first coat dries, the drywaller applies a coat of finish or topping compound over the first coat. When the finish coat dries, he continues using the straight edge of the six-inch knife to scrape residue from the convexly shaped portion of the bullnose. Then, he sands any remainder from the convexly shaped portion. Alternatively, he may attempt to sponge excess from the convexly shaped portion with a wet sponge before the compound dries. In any event, the foregoing method of cleaning drywall compound from the bullnose can be time consuming and frustrating. So, drywallers need a better way to do it.

SUMMARY OF THE INVENTION

This invention solves the problem outlined above by providing a bullnose cleaning tool having a concavely shaped edge that matches the convexly shaped portion of the bullnose. The tool may, for example, take the form of a one inch wide, six to seven inches long, ⅛ inch thick, flat bar of high strength aluminum (e.g., 6061 aluminum). At least one end of the bar has a concavely shaped edge that matches (i.e., at least approximately matches) the convexly shaped portion of the bullnose. So, the drywaller can clean the bullnose more easily by scraping residue with the concavely shaped edge.

To paraphrase some of the claim language subsequently presented, a tool for scraping material from a bullnose installed on a corner joint of a drywall installation includes an elongated device having a handle portion, a first end portion, a second end portion, and a size adapted for holding in one hand. The first end portion has a first concavely shaped edge that matches a convexly shaped portion of the bullnose. It enables a user to scrape the material from the bullnose by moving the concavely shaped edge along the convexly shaped portion of the bullnose.

Preferably, the first concavely shaped edge is shaped to match the convexly shaped portion of the bullnose when the bullnose is installed on a 90-degree corner joint (e.g., a 75-degree arc on a 0.875-inch radius). In addition, the second end portion of the elongated device preferably includes a second concavely shaped edge that is shaped to match the convexly shaped portion of the bullnose when the bullnose is installed on a 135-degree corner joint (e.g., a 50-degree arc on a 1.125-inch radius).

In line with the above, a method for scraping material from a bullnose installed on a corner joint of a drywall installation includes the step of providing a tool in the form of an elongated device having a handle portion, an end portion with a concavely shaped edge that matches a convexly shaped portion of the bullnose, and a size adapted to be held in one hand. The method proceeds by grasping the elongated device in one hand, and then moving the concavely shaped edge along the convexly shaped portion of the bullnose.

Thus, the invention overcomes problems of existing bullnose cleaning methods. The following illustrative drawings and detailed description make the foregoing and other objects, features, and advantages of the invention more apparent.

DESCRIPTION OF THE PREFERRED EMBODIMENTS

Figure 1:
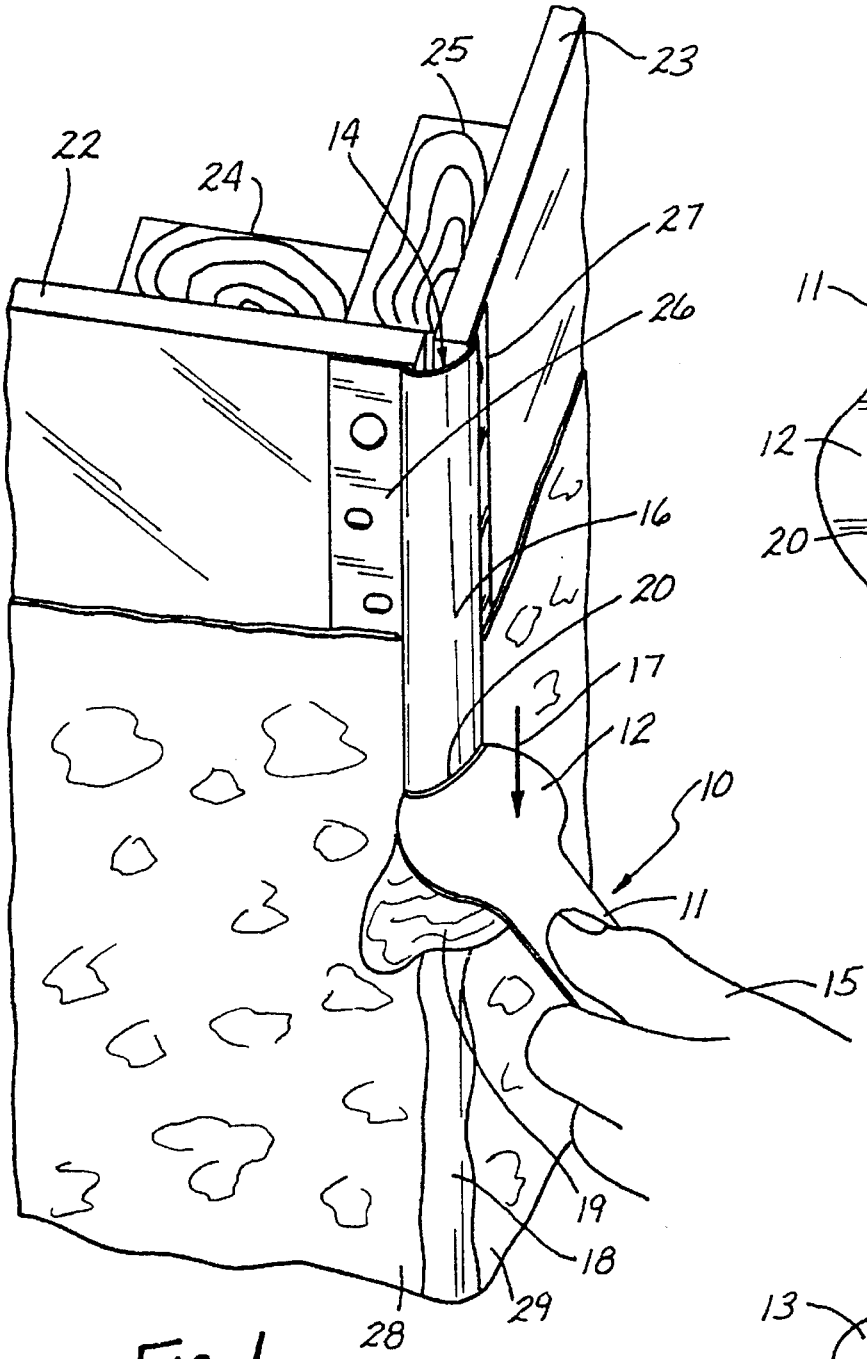
FIG. 1 of the drawings is a three-dimensional view of a tool constructed according to the invention, shown in use by a drywaller cleaning a bullnose installed on a 90-degree corner joint.
Figure 3:
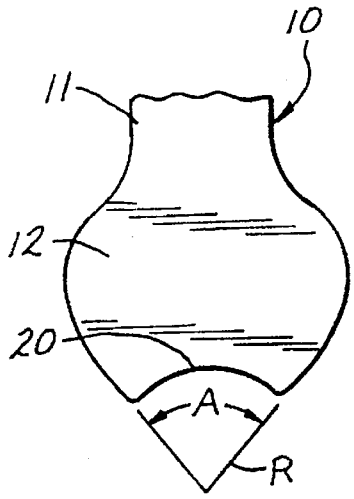
FIG. 3 is plan view of a portion of one tip illustrating edge specifications.
Figure 2:
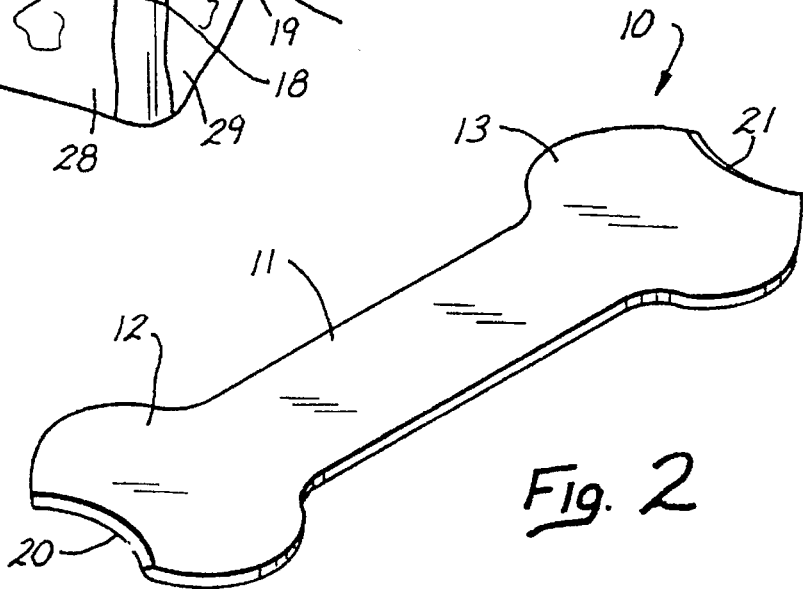
FIG. 2 is an enlarged three-dimensional view of the tool, showing both a 90-degree edge and the 135-degree edge.

The drawings show a tool 10 constructed according to the invention. Generally, the tool 10 is an elongated device having a handle portion or just handle 11 (FIGS. 1–3), a first end portion or first tip 12, a second end portion or second tip 13 (FIG. 2), and a size adapted for holding in one hand. It is used as illustrated in FIG. 1 to remove material from a bullnose 14 installed on a corner joint of a drywall installation (i.e., clean the bullnose).

Preferably, the tool 10 is fabricated in unitary one-piece construction, although one of ordinary skill in the art can fabricate it in other ways without departing from the inventive concepts disclosed. As an idea of size and composition, the illustrated tool 10 is a 6.5 inch long piece of 0.125-inch thick, high strength aluminum (e.g., 6061 aluminum). The handle 11 is about one inch wide and 3-½ inches long, while the first and second tips 12 and 13 are each about two inches wide at their widest points. Of course, other sizes and compositions, including plastic, may be used.

A user 15 grasps the tool 10 in one hand (FIG. 1), positions it against a rounded or convexly shaped portion 16 of the bullnose 14, and moves it as depicted by an arrow 17. Doing so removes residue material 18 (e.g., taping compound) from the convexly shaped portion 16. As the user 15 scrapes the residue material 18, it forms an accumulation 19 which the user may collect and discard or reuse.

To facilitate bullnose cleaning, the first tip 12 includes a first concavely shaped edge (i.e., a first edge 20) that matches the convexly shaped portion 16 of the bullnose 14. Shaped that way, the first edge 20 enables the user 15 scrape the material 18 from the bullnose 14 by moving the first edge 20 along the convexly shaped portion 16 of the bullnose 14. Preferably, the first edge 20 matches the convexly shaped portion 16 when the bullnose 14 is installed on a 90-degree corner joint (as depicted in FIG. 1) and the second tip 13 includes a second concavely shaped edge (i.e., a second edge 21) that matches the convexly shaped portion 16 when the bullnose 14 is installed on a 135-degree corner joint.

In that regard, 90-degree and 135-degree corner joints are common in many drywall installations, a 90-degree corner joint being illustrated in FIG. 1. First and second drywall sheets 22 and 23 are attached to two-by-fours 24 and 25 (or other suitable supporting structure) so that the sheets 22 and 23 meet at a 90-degree angle. The bullnose 14 is then attached to the sheets 22 and 23 so that the convexly shaped portion 16 spans the two sheets in an arc having a radius of about ⅝ inch to about ⅞ inch, or so.

In a similar manner for a 135-degree corner joint (not illustrated), the sheets 22 and 23 would meet at a 135-degree angle so that attaching the bullnose 14 would result in the convexly shaped portion 16 spanning the two sheets in an arc having a radius of about 1.0 inch to about 1-⅛ inch, or so. The thin sheet metal of which the bullnose 14 is composed enables the drywaller to bend it slightly as needed for the particular corner joint on which it is installed.

With further regard to the illustrated 90-degree corner joint, an approximately ⅞-inch wide first marginal edge portion 26 of the bullnose 14 is nailed, screwed, or otherwise suitably attached by known means to the drywall sheet 22, and an approximately ⅞-inch wide second marginal edge portion 27 is suitably attached to the drywall sheet 23. Then, drywall tape sections 28 and 29 are attached with taping compound to the sheets 22 and 23 so that they overlie the marginal edge portions 26 and 27 of the bullnose 14. As the drywaller installs the bullnose 14 that way, the residue material 18 remains on the convexly shaped portion 16 of the bullnose 14.

The first edge 20 matches the convexly shaped portion 16 when the bullnose 14 is installed on a 90-degree corner joint. For that purpose, the illustrated first edge 20 extends in an arc of about 75 degrees (as depicted by an arc A in FIG. 3) having a radius of approximately 0.875 inch (as depicted by a radius R in FIG. 3). The second edge 21 matches the convexly shaped portion 16 when the bullnose 14 is installed on a 135-degree corner joint, resulting in the convexly shaped portion 16 having a slightly larger radius than when the bullnose 14 is installed on a 90-degree corner joint. For that purpose, the illustrated second edge 21 extends in an arc of about 50 degrees having a radius of approximately 1.125 inches. Of course, the exact shape of the first and second edges 20 and 21 may vary somewhat without departing from the invention.

Thus, the invention provides a conveniently used hand tool that overcomes problems of cleaning a bullnose. Although an exemplary embodiment has been shown and described, one of ordinary skill in the art may make many changes, modifications, and substitutions without necessarily departing from the spirit and scope of the invention. For one thing, the edges 20 and 21 need not exactly match the convexly shaped portion of the bullnose 14. Specification herein of a concavely shaped edge that "matches" the convexly shaped portion of the bullnose includes a concavely shaped edge that matches "approximately" as well as one that matches "exactly."

What is claimed is:

1. A tool for scraping material from a bullnose installed on a corner joint of a drywall installation, the tool comprising:

an elongated device having a handle portion, a first end portion, a second end portion, and a size adapted for holding in one hand;

the first end portion having means in the form of a first concavely shaped edge that matches a convexly shaped portion of the bullnose for enabling a user to scrape the material from the bullnose by moving the concavely shaped edge along the convexly shaped portion of the bullnose;

wherein the first concavely shaped edge is shaped to match the convexly shaped portion of the bullnose when the bullnose is installed on a 90-degree corner joint; and wherein the second end portion of the elongated device includes a second concavely shaped edge that matches the convexly shaped portion of the bullnose when the bullnose is installed on a 135-degree corner joint.

2. A tool as recited in claim 1, wherein the elongated device takes the form of a bar of aluminum having the specified shape.

3. A tool as recited in claim 1, wherein the first concavely shaped edge extends in an arc of about 75 degrees having a radius of approximately 0.875 inch and the second concavely shaped edge extends in an arc of about 50 degrees having a radius of approximately 1.125 inches.

4. A tool for scraping material from a bullnose installed on a corner joint of a drywall installation, the tool comprising:

an elongated piece of rigid material having a first end portion, a second end portion opposite the first end portion, a handle portion intermediate the first and second end portions, and a size adapted to be held in one hand;

the first end portion including a first concavely shaped edge that matches a convexly shaped portion of the bullnose when the bullnose is installed in a 90-degree corner joint; and the second end portion including a second concavely shaped edge that matches a convexly shaped portion of the bullnose when the bullnose is installed in a 135-degree corner joint.

5. A tool as recited in claim 4, wherein the elongated piece of rigid material is an aluminum bar having the specified shape.

6. A tool as recited in claim 4, wherein the first concavely shaped edge extends in an arc of about 75 degrees having a radius of approximately 0.875 inch and the second concavely shaped edge extends in an arc of about 50 degrees having a radius of approximately 1.125 inches.

* * * * *